United States Patent [19]

White

[11] Patent Number: 4,653,417

[45] Date of Patent: Mar. 31, 1987

[54] WIND PROPELLED VESSEL

[76] Inventor: Christopher R. White, 48 Bush St., So. Dartmouth, Mass. 02748

[21] Appl. No.: 708,726

[22] Filed: Mar. 6, 1985

Related U.S. Application Data

[63] Continuation-in-part of Ser. No. 587,247, Mar. 7, 1984, Pat. No. 4,537,145.

[51] Int. Cl.[4] ..... B63B 15/02

[52] U.S. Cl. ..... 114/91; 114/39; 114/61; 114/98

[58] Field of Search ..... 114/39, 39.1, 61, 89, 114/90, 91, 97, 98, 102, 204

[56] References Cited

U.S. PATENT DOCUMENTS

| | | | |
|---|---|---|---|
| 641,321 | 1/1900 | Perkins | 114/91 |
| 1,916,459 | 7/1933 | Blackman | 114/91 |
| 2,643,628 | 6/1953 | Sveinsson | 114/91 X |
| 3,272,167 | 9/1966 | De Monfreid | 114/102 X |
| 3,839,979 | 10/1974 | Wassell | 114/61 |
| 4,005,669 | 2/1977 | Klemm | 114/91 |

FOREIGN PATENT DOCUMENTS

| | | | |
|---|---|---|---|
| 2139895 | 2/1973 | Fed. Rep. of Germany | 114/39.1 |
| 3013411 | 10/1981 | Fed. Rep. of Germany | 114/61 |
| 3234163 | 3/1984 | Fed. Rep. of Germany | 114/91 |
| 2059857 | 5/1971 | France | 114/91 |

*Primary Examiner*—Sherman D. Basinger
*Assistant Examiner*—Paul E. Salmon
*Attorney, Agent, or Firm*—John F. C. Glenn

[57] ABSTRACT

Sailboat has mast tiltable aftward as well as a thwartship when bottom of mast is shifted from central position on athwartship track. Above the track the mast connects with a pair of rigid supports which diverge toward hinged connections on opposite sides of the boat forward of the mast.

8 Claims, 7 Drawing Figures

WIND PROPELLED VESSEL

Continuation-in-part of application Ser. No. 587,247 filed Mar. 7, 1984 and issued as U.S. Pat. No. 4,537,145 on Aug. 27, 1985.

BACKGROUND OF THE INVENTION

Since the earliest days of seafaring, increased speed of sailboats has been sought. In recent times, the demand for very high speed sailing craft by recreational sailors has created a large boatbuilding industry specifically to provide extremely fast sailing craft.

Previous efforts at the design of high speed sailboats have centered on one or more of the following steps to reduce the frictional and wave making resistance of the hull(s): vessel weight reduction, efficient hull forms (i.e., catamarans and planing hulls), or hydrofoils with which the hull is lifted out of the water. All of these methods have increased sailing speed to some extent. However, the most dramatic speed breakthrough in many years has been achieved by the sailboard. This vessel consists of a surfboard-shaped hull to which a freely pivoting mast and sail is attached. The sail is restrained only by the operator; see U.S. Pat. No. 3,487,800 of Schweitzer and Drake (1970). A direct consequence of the "Free Sail System" of Schweitzer and Drake is that in strong winds the operator inclines the sail to windward, rather than allowing the sail to heel away from the wind as is the case with all conventionally rigged sailboats. Because the wind-induced force of a sail (or aerofoil) is always perpendicular to its surface, when the sailboard sail is inclined to windward it has a portion of this force directed upwardly against the downward force of gravity. This upward force lifts the hull partially (or even completely) out of the water, thereby reducing its frictional and wave making resistance, and increased speed results.

This concept is well documented. There are examples of sailing vessels designed to utilize "lift" producing sails dating back to the 1800's.

Of all the previous attempts at "lifting sails", only the "Free Sail System" of Schweitzer and Drake allows the sail to swing about all three of the major axes, extending fore and aft, athwartships, and up from the deck. However, the mast is pivoted at its base about a socket in a fixed position on the deck. It is desirable that the sail be readily pivotable about all three axes for the following reason. As the sail is shifted to windward of the vessel, it causes an imbalance of forces commonly known as "lee helm", which is the tendency of the vessel to turn away from the wind. To correct this problem, the sail must be tilted farther aft. This will bring the drive and drag producing forces back into equilibrium and the vessel will steer straight ahead.

The limiting condition of the "Free Sail System" is that it must be "substantially free from pivotal restraint", meaning that the operator actually holds the sail up against the wind without the help of any mechanical devices. This causes the sailboard to be very strenuous to operate and further confines its tri-axis control "lifting sail" concept to very small vessels with very small sails.

These developments have left unsolved the problem of how to obtain the benefits of a sail controllable about all three major axes in a manner suitable for use on larger, more stable sailing vessels.

SUMMARY OF THE INVENTION

The present invention provides the operator of a sailboat with the means to incline the sail athwartship into the wind while simultaneously and automatically tilting the sail aft by the amount needed to offset the "lee helm" produced when the center of effort of the sail is shifted to windward of the centerline of the vessel.

The degree of movement in any direction can be restricted to the normal range of sailing usage. This prevents the sail from falling into the water or otherwise moving too far.

Athwartship inclination, and fore and aft tilting can be accomplished with or without mechanical advantage, depending on the size of the vessel.

Other details and advantages of the invention will become apparent as the following description of the embodiment thereof in the accompanying drawings proceeds.

A BRIEF DESCRIPTION OF THE DRAWINGS

DETAILED DESCRIPTION OF THE PRESENT PREFERRED EMBODIMENTS

Figure 1:
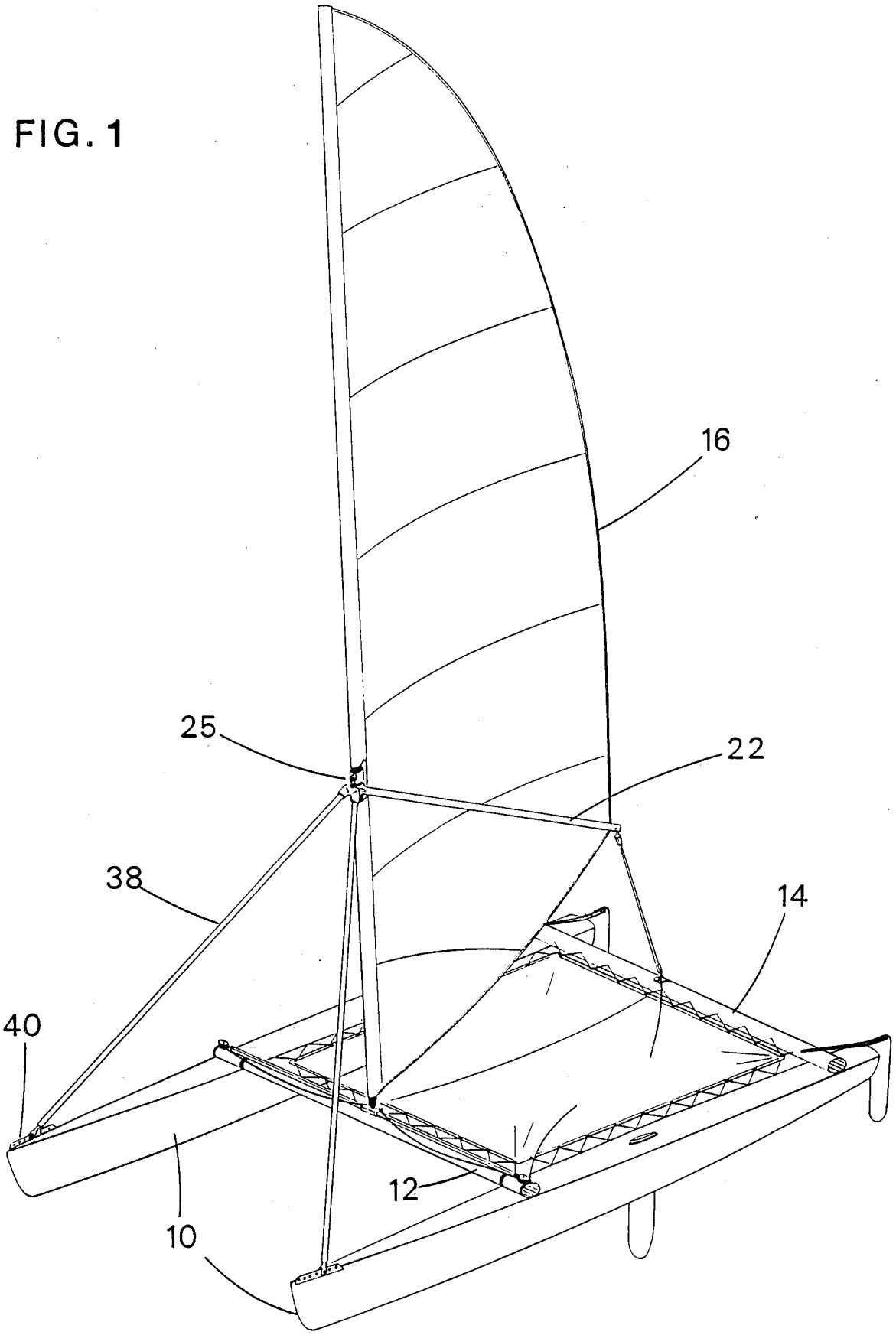
FIG. 1 is a perspective view of a sailing vessel embodying the invention.
Figure 2:
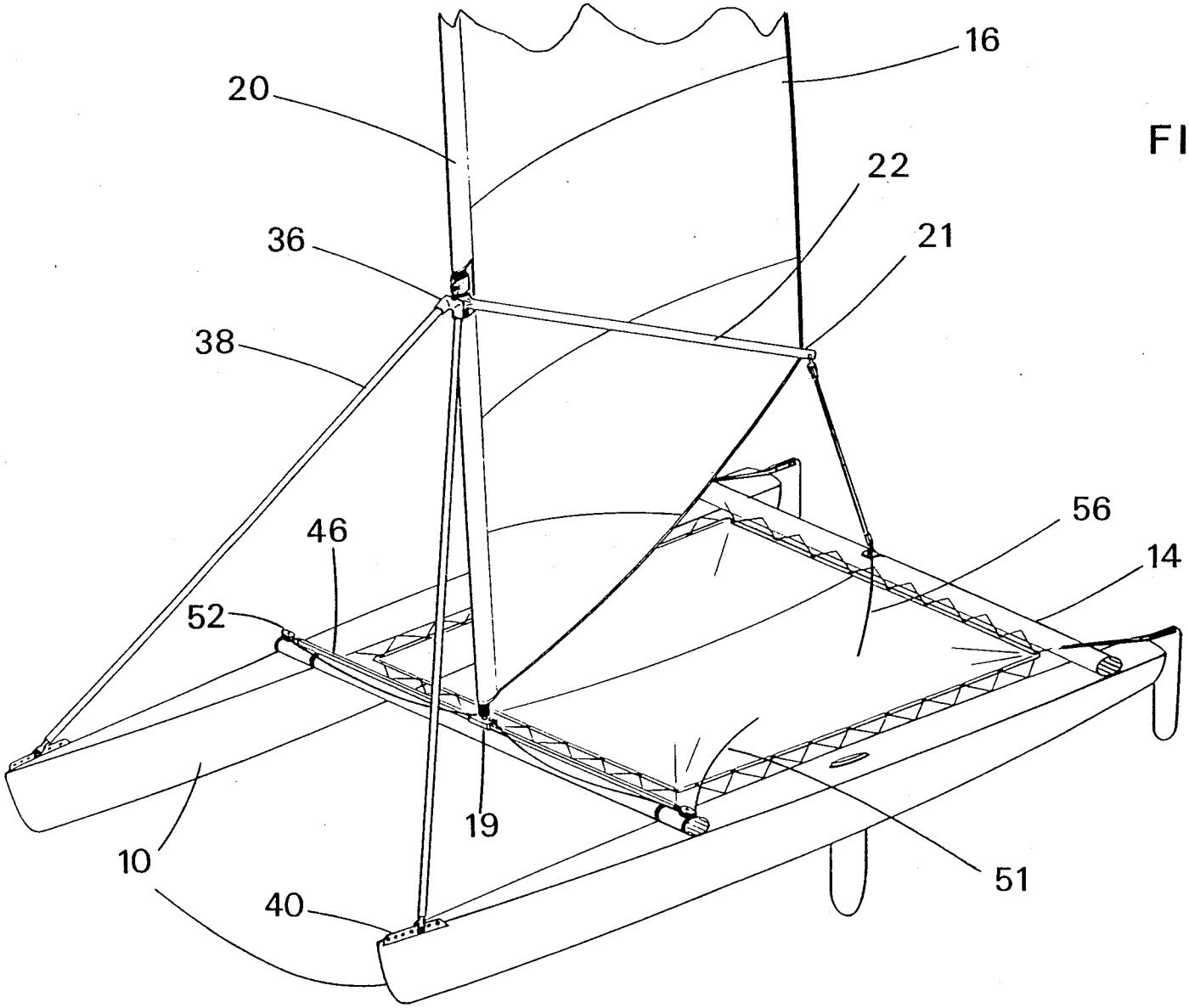
FIG. 2 is an enlarged view of FIG. 1.
Figure 3:
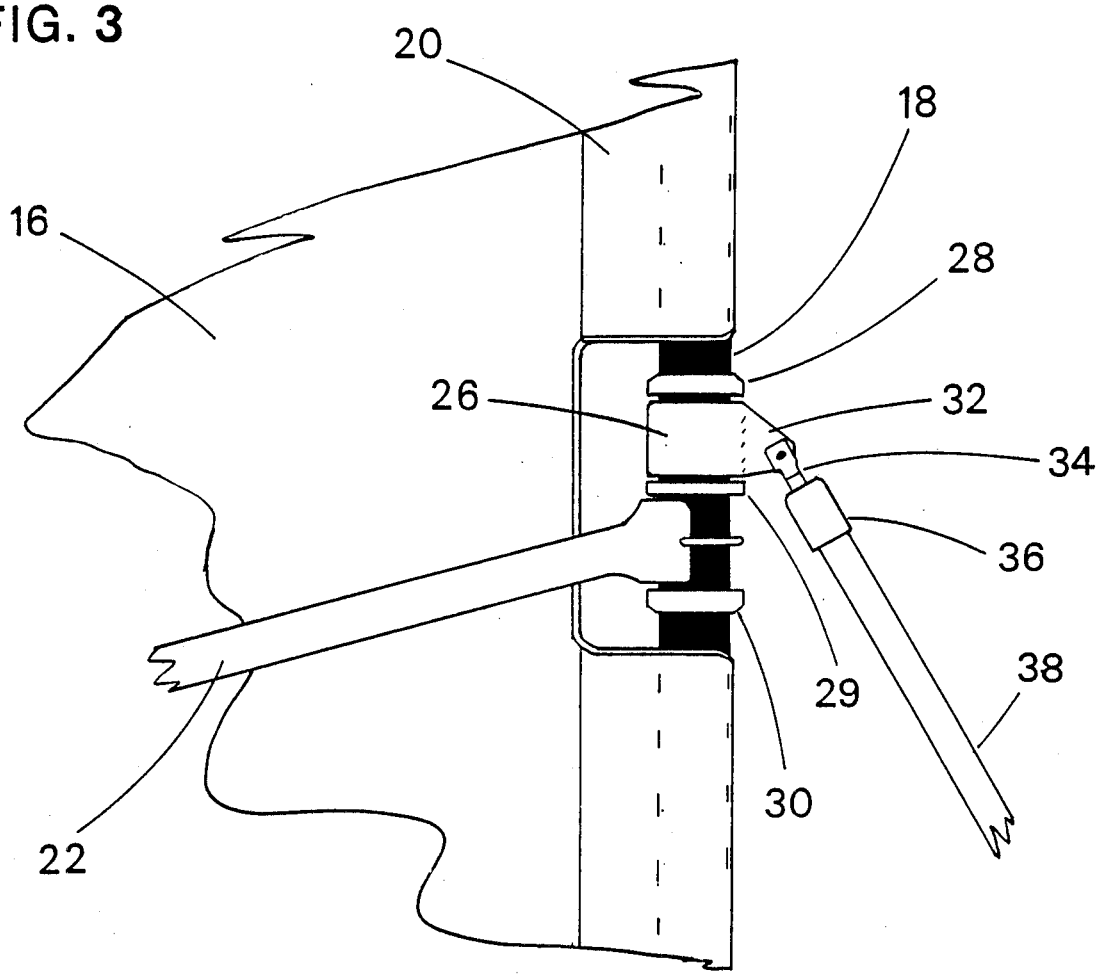
FIG. 3 is a profile view of the upper mast holding means.
Figure 4:
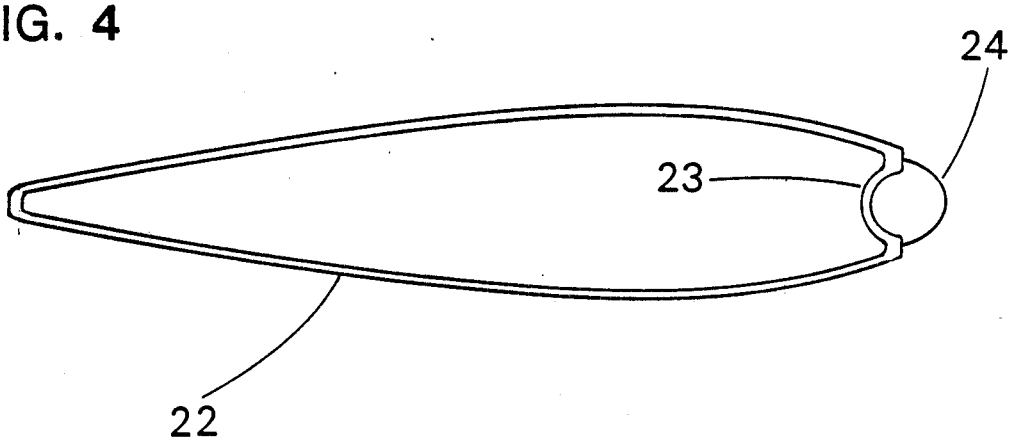
FIG. 4 is a plan view of the wishbone boom and goosneck.
Figure 5:
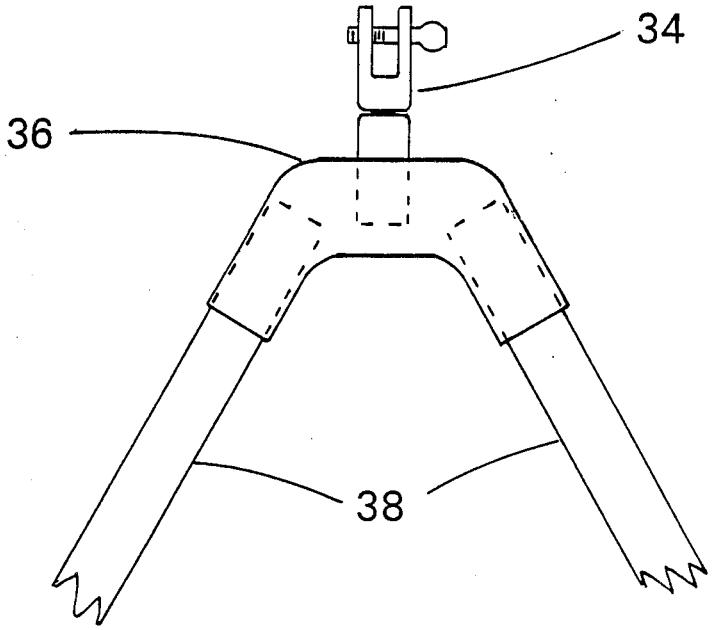
FIG. 5 is a profile view of the bipod apex fitting and swivel joint.
Figure 6:
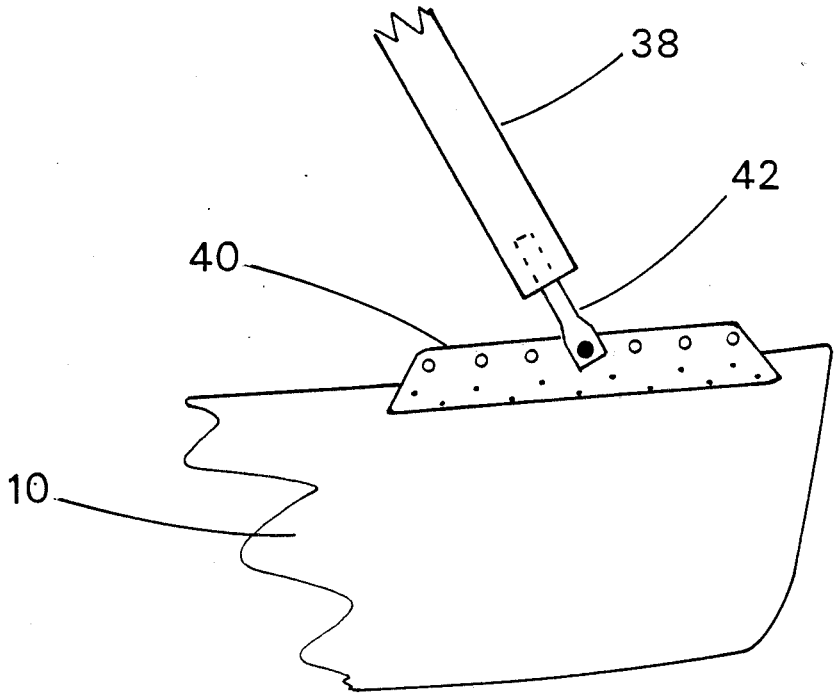
FIG. 6 is a profile view of the lower end of the bipod leg and its attachment to the hull.
Figure 7:
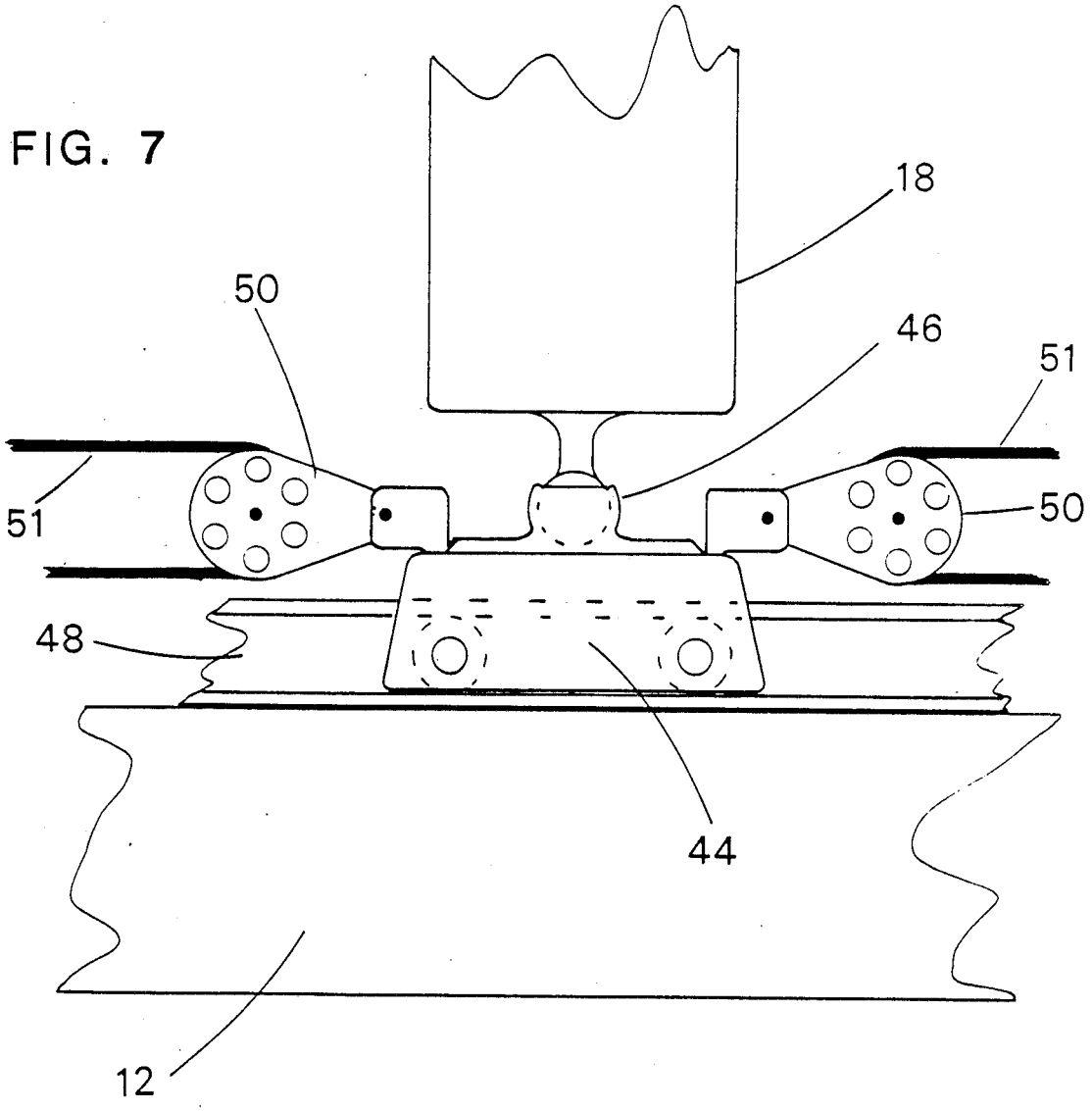
FIG. 7 is a profile view of the mast step, universal joint, and means for athwartship adjustment.

The type of vessel chosen to demonstrate the present preferred embodiment of the invention is a catamaran. It comprises two hulls 10 which are firmly secured together in a parallel relationship with a forward crossbeam 12 and an after crossbeam 14.

A triangular sail 16 is secured along one side to a mast 18. The preferred method of attachment is by a fabric sleeve 20 affixed to the sail 16 through which the mast 18 is inserted.

The other two sides of the sail converge to a point 21, which is fastened to the end of a boom 22. The boom 22 is preferably of the wishbone type, secured to the mast 18 by means of a goosneck fitting 23. In use the goosneck fitting 23 is pressed firmly on the mast 18 but a retaining line 24 is provided to hold the goosneck 23 in place when the sail 16 is being rigged.

Mounted on the mast 18, directly above the goosneck fitting 23 is the upper mast holding means 25. It is positioned less than half way up the mast and consists of a collar 26 that is free to rotate around the mast 18 but is restrained from sliding up or down by means of stops 28,29,30. On the forward side of the collar is a bracket 32 which has a hole to admit a swivel shackle 34. The swivel shackle 34 is firmly joined to the apex fitting 36 of the bipod 38. The apex fitting 36 must be able to withstand large forces—a fiber (Kevlar TM) reinforced plastic is suggested. The two legs of the bipod 38 are preferably made of aluminum tubing. They connect to chainplates 40 mounted near the bows of the catamaran hulls 10 by means of 'fork' type end fittings 42. By shifting the end fittings forward or aft along the chainplate 40, adjustment of the mast tilting is possible. The lower end of mast 18, the step 19, is secured to a ball bearing car 44 by means of a universal joint 46. The ball bearing car 44 is designed to roll along a length of 'I' beam track 48, which is firmly attached to the forward crossbeam 12. Block and tackle 50,51,52 are used to position the mast step 19 to any place along the length of the 'I' beam track 48.

Positioning the mast step 19 all the way toward the leeward end of I beam track 48 inclines the mast 18 to windward. The maximum desirable amount of inclination is usually about 30° from vertical. If the length of the I beam track 48 is approximately the same as the distance from the I beam track 48 to the upper mast holding means 25, the proper amount of athwartship inclination will be possible. Stops at the end of the I beam track 48 prevent movement of the mast step 19 beyond the desirable range.

The upper mast holding means 25 is prevented from moving substantially sidewise relative to the hull by its design, but is free to pivot around the axis through the bipod end fittings 42. This feature serves to tilt the mast 18 aft as the mast step 19 is positioned farther the centerline of the catamaran.

The relationship between athwartship inclination and fore and aft tilting can be altered by adjusting the distance between the I beam track 48 and the lower end of the bipod 38. This is accomplished by repositioning the fork end fittings 42 along the length of the chainplates 40. Decreasing this distance serves to increase the for and aft tilting for the same amount of athwartship inclination. Generally the mast 18 is tilted forward and aft as a direct consequence of athwartship inclination. But tilting the mast 18 forward and aft independently of any athwartship inclination is possible by adjustment of the bipod end fittings 42 along the length of the chainplates 40.

If more rapid independent tilting adjustments are desired, the chainplates 40 may be replased by an I beam track and car similar to 48,44.

Sailing the vessel: In light winds, no appreciable advantage is gained from inclining the sail 16 to windward, and it would be positioned nearly vertical. However, as the wind increases, it becomes desirable to use the sail 16 to produce vertical lift as well as forward thrust. Because the center of pressure of the sail 16 is located above the upper mast holding means 25, the mast step 19 will be forced to windward. The operator controls and restrains the movement of the mast step 19 by adjusting tackle 51 located on the leeward side. Pulling the mast step 19 to leeward inclines the sail 16 into the wind.

The procedure for tacking the vessel is as follows: First, sheet tackle 56 is eased in order to reduce the wind pressure on the sail 16. While simultaneously slacking off tackle 51 and steering vessel into the wind, the mast step 19 can be shifted to the new leeward side. The new leeward tackle 51 is cleated off, sheet tackle 56 tightened and the tack is complete.

The invention is adaptable to other types of sailing vessels, such as monohulls and trimarans. In particular, a monohull vessel of the 'scow' type is well suited for the invention. The wide overall beam and wide beam forward in the bow would make fitting the invention possible with little or no modification to the hull.

While present preferred embodiments and practices of the invention have been described and illustrated, the invention may be otherwise variously embodied and practiced within the scope of the following claims.

I claim:

1. A sailing vessel comprising flotation means elongated in the fore and aft direction, a mast, lower mast supporting means connected to the mast adjacent to its lower end, means for adjusting the position of said lower mast supporting means along a path extending transversely of said elongation, said path having a center between its ends upper mast supporting means connected to the mast above its connection with the lower supporting means and to the flotation means forward of said path for hinging movement about an axis transverse of said elongation, said upper mast supporting means extending rigidly between its ends so that said hinging movement causes one end to swing in a plane normal to said axis and parallel to said elongation, whereby transverse movement of the lower mast supporting means along said path away from said center of said path causes the mast to tilt both athwartship and aftward.

2. A sailing vessel in accordance with claim 1, in which the flotation means is a plurality of parallel elongated flotation means.

3. A sailing vessel according to claim 1 in which the flotation means is a pair of catamaran hulls.

4. A sailing vessel according to claim 1, in which said upper mast supporting means is mounted on the flotation means forward of the mast, and comprising a boom aft of the mast and connected at one end to the mast for swinging movement about the mast, the boom being adapted to cooperate with the mast in supporting a substantially triangular sail.

5. A sailing vessel according to claim 4, in which the upper mast supporting means comprises a pair of rigid members having convergent ends adjacent to the upper mast supporting means connection and divergent ends adjacent to and spaced along the transversely extending axis of hinging movement.

6. A sailing vessel according to claim 5, comprising means to adjust the positions of said divergent ends in a fore and aft direction and correspondingly shift said axis laterally in the same direction.

7. A sailing vessel comprising flotation means elongated in the fore and aft direction, a mast, a track extending across the flotation means substantially normal to the fore and aft direction, means supporting the lower end of the mast on the track, means operable by a crew for adjusting the position of the lower end of the mast along the track, and a pair of rigid members of substantially equal length and having their upper ends converging toward and connected to the mast above its lower end and their lower ends diverging toward and connected to the flotation means, said lower end connections being hinged and at fixed positions along a line extending substantially parallel to and forward of said track, whereby adjustment of the lower mast end from a central position along the track causes the mast to tilt in a direction having an athwartship and an aftward component.

8. A sailing vessel in accordance with claim 7, in which the pair of rigid members are connected to the mast less than half way up its length.

* * * * *